US005293917A

United States Patent [19]

Kalliokoski

[11] Patent Number: 5,293,917

[45] Date of Patent: Mar. 15, 1994

[54] DISC CHIPPER FEEDING METHOD AND DISC CHIPPER

[75] Inventor: Alpo Kalliokoski, Pori, Finland

[73] Assignee: Sunds Defibrator Woodhandling Oy, Pori, Finland

[21] Appl. No.: 971,207

[22] Filed: Nov. 4, 1992

[30] Foreign Application Priority Data

Nov. 11, 1991 [FI] Finland ..... 915321

[51] Int. Cl.[5] ..... B27L 11/00; B27C 1/12

[52] U.S. Cl. ..... 144/373; 144/162 R; 144/176; 144/247 R; 241/92; 241/278.1

[58] Field of Search ..... 144/162 R, 176, 242 R, 144/373; 241/92, 278

[56] References Cited

U.S. PATENT DOCUMENTS

| | | | |
|---|---|---|---|
| 3,266,539 | 8/1966 | Gantt | 144/176 |
| 3,276,700 | 10/1966 | Eklund | 144/176 |
| 3,866,843 | 2/1975 | Lunn | 144/176 |
| 4,160,471 | 7/1979 | Lapointe | 144/176 |
| 4,827,989 | 5/1989 | Strong | 144/176 |

FOREIGN PATENT DOCUMENTS

| | | |
|---|---|---|
| 350958 | 3/1922 | Fed. Rep. of Germany . |
| 3210840 | 10/1983 | Fed. Rep. of Germany . |
| 854334 | 5/1987 | Finland . |
| 79799 | 11/1989 | Finland . |

OTHER PUBLICATIONS

Paper presented in Seminar, Mr. Matti Kahilahti, pp. 1-9 and Appendices I-V (no translation) Nov. 1988. Drawings four (4) pages (1986).

*Primary Examiner*—W. Donald Bray

*Attorney, Agent, or Firm*—Burns, Doane, Swecker & Mathis

[57] ABSTRACT

A method for the feeding of long pieces of wood into a disc chipper against a disc (3) equipped with blades in such a way that the piece of wood encounters the bladed disc at a sharp input angle, and a disc chipper. The sharp input angle is achieved by combining with the sharp inclination (≃) of the feeder chute (5) a sharp level slanting angle, whereupon the inclination of feeder chute (5) will be sufficient to feed wood against the blade disc.

7 Claims, 4 Drawing Sheets

DISC CHIPPER FEEDING METHOD AND DISC CHIPPER

BACKGROUND OF THE INVENTION

This invention concerns a method for the feeding of long pieces of wood into a disc chipper against a disc equipped with blades, rotating around a horizontal axis, in such a way that the piece of wood encounters the bladed disc at a sharp input angle, whereupon the sharp input angle (or the angle between the direction of the piece of wood and the plane of the disc, the angle of the piece and wood perpendicular to the plane of the disc) is achieved by combining with the sharp inclination of the piece of wood the angle around the axis of the disc, i.e. combining with the projection of the angle at the plane of the disc between the direction of the piece of wood and the horizontal direction, a sharp angle of rotation around the vertical axis, i.e. the projection on the horizontal level of the angle between the piece of wood and the plane of the disc. The invention also concerns a disc chipper for the chipping of long pieces of wood, in which the chipper has a disc rotating about a horizontal axis, equipped with blades and with an inclined chute feeder, in which the angle between the chute feeder and the blade disc is sharp, whereupon the sharp angle between the chute feeder and the plane of the disc, perpendicular to the plane of the disc and in the direction of the chute, is formed by combining with the sharp angle of inclination of the chute feeder around the axis of the chute, i.e. the angle between the direction of the chute and the horizontal direction, a projection on the level of the disc around the vertical axis of the sharp angle of rotation around the vertical axis, i.e. with a projection on the horizontal plane of the angle between the chute feeder and the plane of the disc.

The forest industries today commonly use disc chippers to chip wood before further processing. One disc chipper is described in Finnish patent 79799.

When wood is fed in, it encounters the blade disc at an input angle, which is achieved with a horizontally fed chipper by the angle on the horizontal plane between the feeder conveyor and the blade disc, or on a chute fed chipper by the angle of inclination on the vertical plane of the chute. Tests indicate that the chip quality is improved when the input angle between the wood and the blade disc is narrowed.

On a horizontal feed chipper, it is easy to do this, since the change in the angle is done at ground level. The problem with a horizontal feed chipper, however, is that short pieces of wood cannot be fed against the chipper, since a horizontal conveyor cannot be built against the blade disc.

It is difficult to build a steep chute for a chute chipper, as is the feeding of wood. Furthermore, a steep chute results in an irregular feed and feeding at a high feed force. Today there are chute fed chippers on the market which achieve a reasonable chute input angle between a small piece of wood and the blade disc by inclining the axis of the blade disc. The problem with this structure is that all parts have to be installed on a sloping surface.

SUMMARY OF THE DISCLOSURE

It is characteristic of the method and the disc chipper in accordance with this invention that the input angle does not exceed 34°.

The feeder system in accordance with the invention achieves a small input angle with a gently sloping chute by feeding the pieces of wood against the blade disc in such a way that the chipper input is an intermediate form between that of a horizontal feed chipper and a present-day chute feed chipper. This feeder system achieves a controlled input to the chipper, whereupon the height of the feeder chute is considerably lower than at present and the feed force caused by gravity is slight but adequate. In addition, the wood is directed to the base of the chute in a better way with a gently sloping chute which has an angle of inclination which is, however, large enough to make the wood move against the blade disc.

BRIEF DESCRIPTION OF THE DRAWINGS

The invention and its details are described in greater detail in the following, with reference to the attached drawings.

FIG. 7 shows the disc viewed horizontally from the axis, and FIG. 8 shows it viewed from above.

DETAILED DESCRIPTION OF PREFERRED EMBODIMENTS

Figure 1:
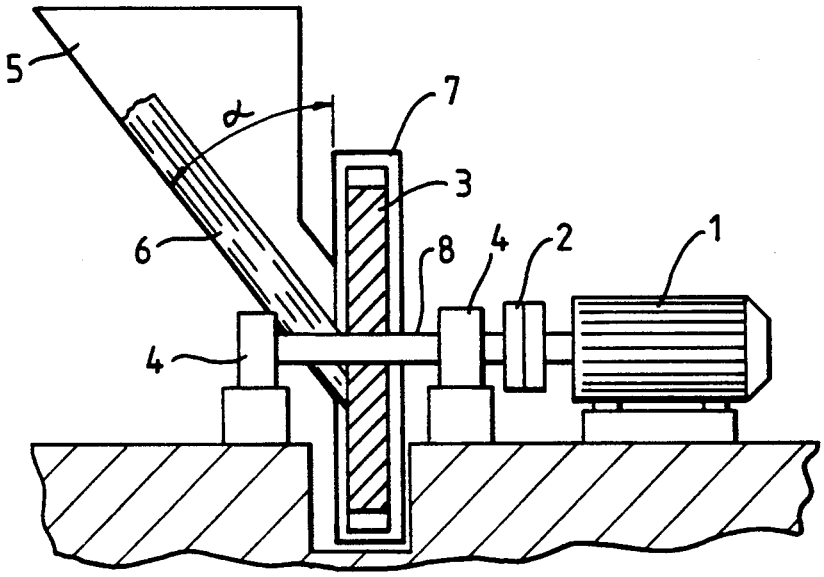
FIG. 1 shows a diagrammatic representation viewed from the side of a present-day chute fed chipper.
Figure 2:
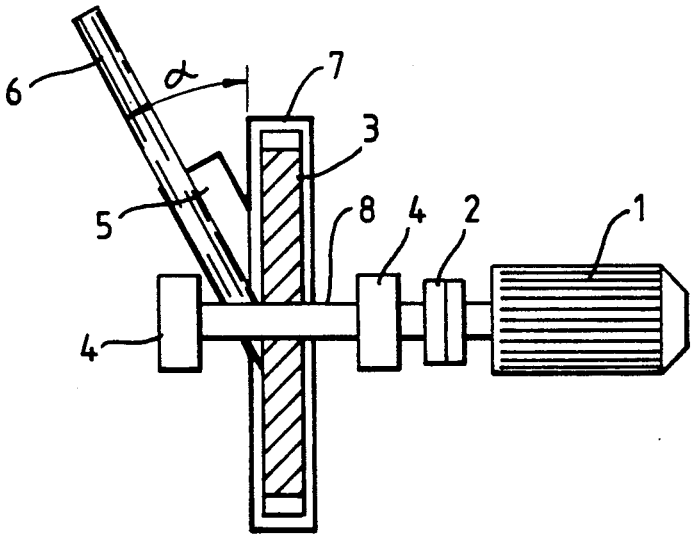
FIG. 2 shows a horizontal feed chipper viewed from above.

The most common type of chipper on the market is of the chute fed type shown in FIG. 1. Horizontal chippers as shown in FIG. 2 are also common. Such a chipper consists of a drive motor 1, switch 2, blade disc 3 on horizontal axle 8, housing 7, feeder chute 5 and bearings 4.

The chipper shown in FIG. 1 is fed with the help of chute 5, in which the end of piece of wood 6 is pressed by gravity against blade disc 3. Chute 5 is inclined relative to the vertical axis, and the overall angle of inclination is almost $90° - \alpha$. Input angle $\alpha$ is the angle between the plane of the tree trunk and the disc on the plane of the disc axle, i.e., at right angles vertically relative to the plane of the disc. In the projection viewed from above, the tree trunk is at a small angle to the disc axis because feeder chute 5 is also slightly rotated relative to the vertical axis. Input angle $\alpha$ can be narrowed by increasing the angle of inclination of the chute.

On the chipper shown in FIG. 2, feeder chute 5 is horizontal and piece of wood 6 is pressed horizontally against the blade disc by a conveyor. Input angle $\alpha$ is formed by the angle between the horizontal conveyor's oblique feeder direction and the plane of the disc, on the horizontal plane. The problem with this, however, is that short pieces of wood do not go into the chipper because the conveyor cannot be built against the blade disc.

In present solutions, input angle $\alpha$ is 36°-38°. Studies have shown that better chip quality is obtained when input angle $\alpha$ of piece of wood 6 relative to the blade disc is smaller, i.e. what is new in this is a smaller input angle known as angle $\beta$.

Figure 5:
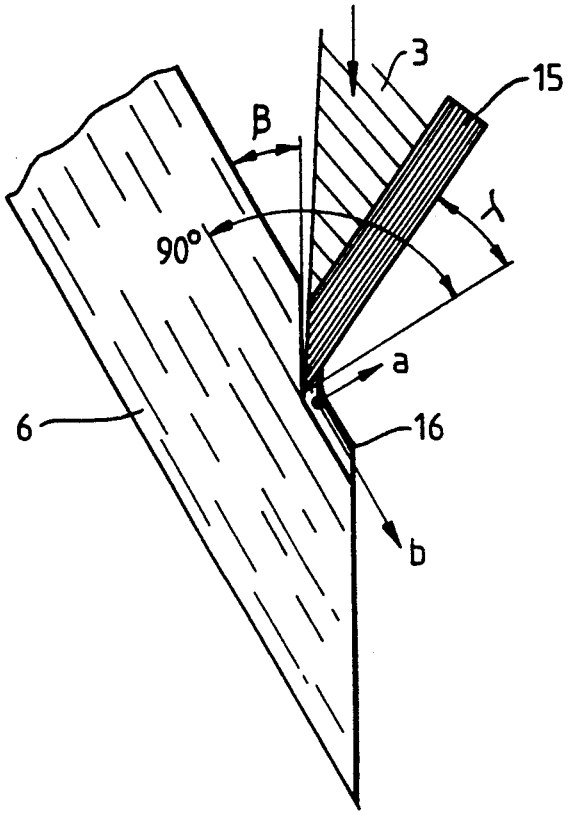
FIG. 5 shows the effect of the input angle on the chipping.

Piece of chip 16 shown in FIG. 5 is detached from piece of wood 6 by shearing force $\beta$ and splitting force $\alpha$ of blade 15. A large shearing force $\beta$ will result in the head of chip 16 jamming, while on the other hand the splitting force a makes the chip thinner and facilitates its loosening as well as reducing jamming and the need for power. Chipping angle $\lambda$ is the angle between the perpendicular direction of the tree trunk and the surface of the blade away from the tree trunk. Splitting force $\alpha$ increases rapidly with chipping angle $\lambda$. The tip of blade 15 should be at about 32°-35° for reasons of durability, so increasing chipping angle $\lambda 0$ should be done by reducing input angle $\alpha$ to angle $\beta$. It follows that when $\beta < \alpha$, better chips are obtained.

Figure 3:
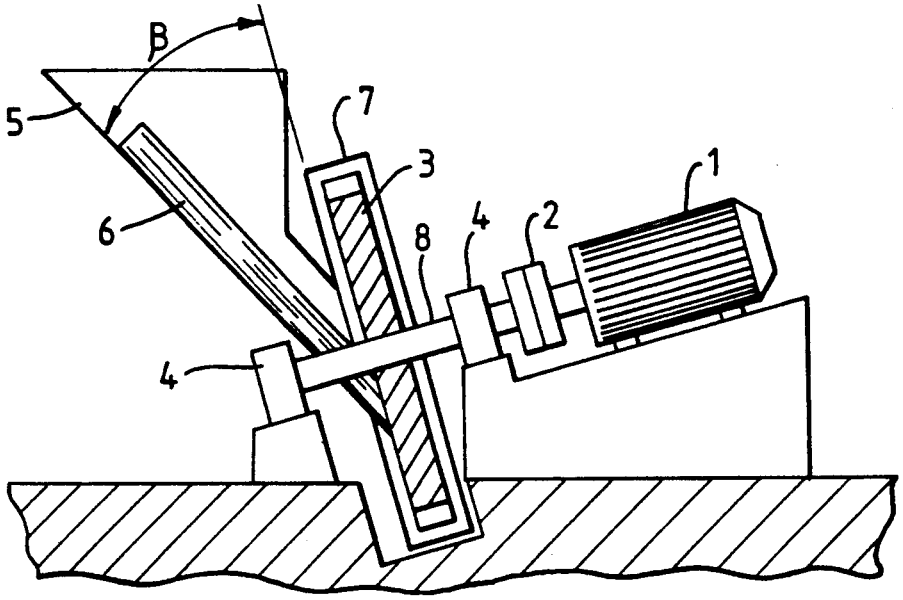
FIG. 3 shows an inclined chute fed chipper, viewed from the side.

Feeding a long piece of wood in a chipper as shown in FIG. 1 is difficult when the chute has a reduced input angle $\beta$, i.e. a very sharp angle of inclination of 90°. For this reason a chute fed chipper as shown in FIG. 3 has been developed; in this, blade disc 3 is angled towards chute 5 and the input angle has thus been reduced to angle $\beta$ between the direction of the wood and the plane of the disc. However, a chipper as shown in FIG. 3 is difficult to set up, install and service.

Figure 4:
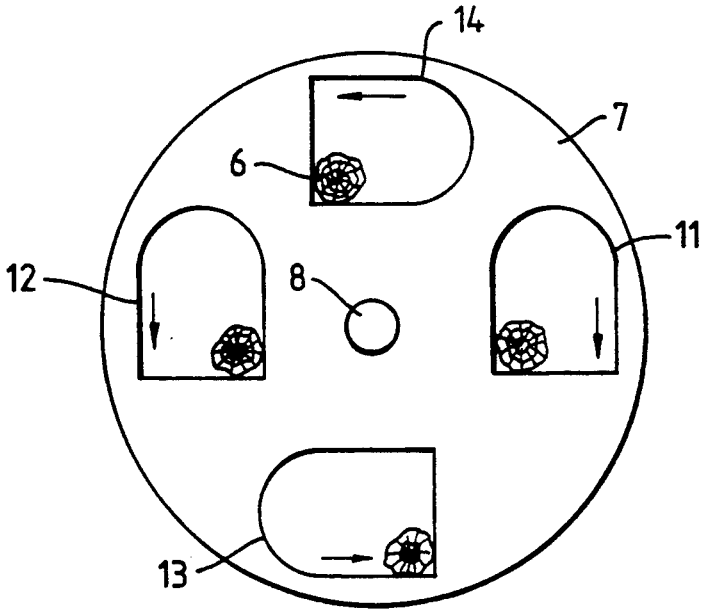
FIGS. 4 shows the positioning of the previously mentioned chippers' feeder vents.

In FIG. 4 is shown in one picture the feeder vent 11-14 between chute feeder 5 and housing 7 as well as alternative positionings of tree trunk 6 in the vent in the three different solutions described above, with the direction of the disc's question.

Figure 6:
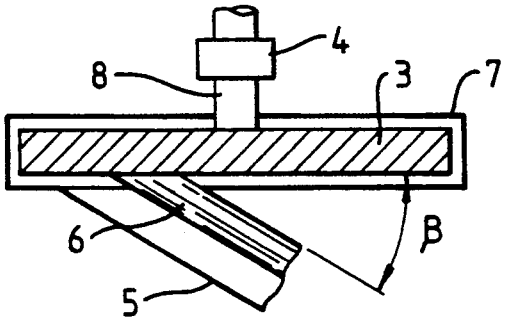
FIGS. 6, 7 and 8 show diagrammatically the chipper structure in accordance with the invention, FIG. 6 at right angles to the plane of the disc and towards the feeder chute.
Figure 7:
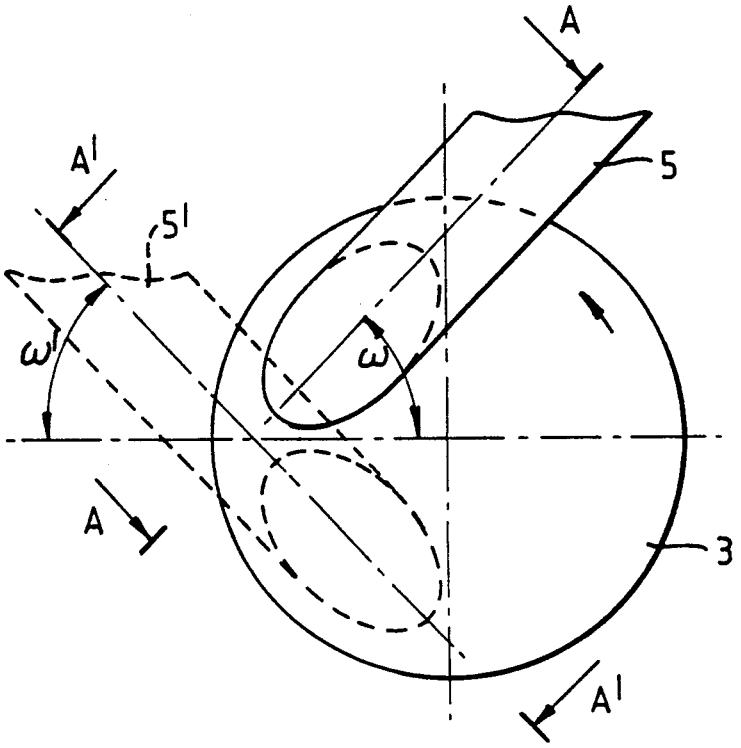
Figure 8:
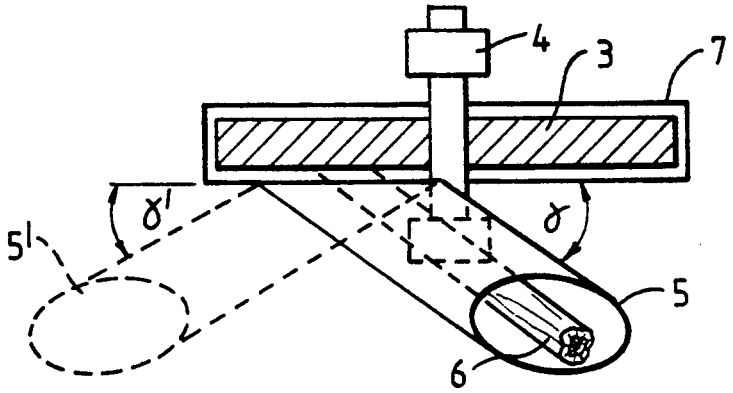

FIGS. 7 and 8, which are in accordance with the invention, show the feeding of wood against blade disc 3 based on the selection of the desired input angle B shown in FIG. 6, which may be 30°-34+, for example. Chute feeder 5 which, when viewed from above (FIG. 8), forms an acute angle $\gamma$ with the plane of the disc, is also inclined by an acute angle $\omega$ (FIG. 7) around the perpendicular axis of blade disc 3, in such a way that an adequate inclination to feed the wood against the blade disc is achieved, which inclination is considerably smaller than 90°-$\alpha$ (FIG. 1). Angle $\omega$ is then 30°-60°. Angle $\gamma$ will then be the sum of input angle $\beta$ and angle of inclination $\omega$.

The input of wood in accordance with the invention can also be arranged above the middle axis, whereupon chute feeder 5' is as shown with dotted lines, i.e., encounters the left half of the disc from the opposite direction in FIGS. 7 and 8, i.e., from the left, when the disc rotation in FIG. 7 is anticlockwise. In each case, the direction of the wood being fed is "downstream" following the movement of the surface of the disc. In other words, the horizontal and vertical components of the projection in the direction of the plane of the disc in the feeding direction are the same as the horizontal and vertical components of the disc surface movement.

The feeding shown in FIGS. 7 and 8 achieve the desired angle of encounter $\beta$, a small input height and a gradually sloping chute, and the structure of the chipper can be kept horizontal.

The gently sloping chute feeder 5 reduces the impact of pieces of wood 6 against the blade disc 3 and enables a steady feed along the bottom of chute 5. These characteristics further improve the quality of the chips.

There follows a summary of the various angles which appear in the text:

1) The input angle or angle of encounter $\alpha$ or $\beta$ = the angle between the tree trunk and disc plane in the direction of the tree trunk, in the plane perpendicular to the plane of the disc.
2) The tree trunk or chute feeder inclination angle $\omega$ = the angle between the direction of the trunk or the chute and the horizontal in the projection viewed towards the axis of the blade disc.
3) Angle of rotation $\gamma$ on the horizontal plane around the vertical axis = the projection of the angle between the tree trunk and the plane of the blade on the horizontal plane. (In previously known horizontal feeds, angle of rotation $\gamma$ = input angle $\alpha$).

The above refers to the disc's axis of rotation on the plane of the disc against the perpendicular.

I claim:

1. A method for feeding a long piece of wood into a disc chipper having a disc equipped with blades rotating around a horizontal axis, comprising:

feeding the piece of wood such the piece of wood encounters the disc at an input angle $\beta$, which is the angle between the piece of wood and a line in a plane in which the disc is located, wherein said line passes through a point in the plane where said piece of wood contacts said disc and which extends tangentially in a direction in which the disc is moving at that point;

said input angle $\beta$ includes an angle $\omega$, which is an angle between a projection of the piece of wood against the plane in which the disc is located and the horizon;

said angle $\omega$being less than 90°;

said input angle $\beta$ further includes an angle $\gamma$, which is an angle between a projection of the piece of wood against a floor surface and the plane of the disc;

said angle $\gamma$ being less than 90°; and said input angle $\beta$ being no greater than 34°.

2. The method of claim 1, wherein said angle $\omega$ is within the range of 30° and 60°.

3. A disc chipper for chipping a long piece of wood, comprising:

a disc rotating about a horizontal axis;

an inclined chute for feeding the piece of wood to the disc;

said chute arranged such that the piece of wood encounters the disc at an input angle $\beta$, which is the angle between the piece of wood and a line in a plane in which the disc is located, wherein said line passes through a point in the plane where said piece of wood contacts said disc and which extends tangentially in a direction in which the disc is moving at that point;

said input angle $\beta$ includes an angle $\omega$, which is an angle between a projection of the piece of wood against the plane in which the disc is located and the horizon;

said angle $\omega$ being less than 90°;

said input angle $\not\equiv$ further includes an angle $\gamma$, which is an angle between a projection of the piece of wood against a floor surface and the plane of the disc;

said angle $\gamma$ being less than 90°; and said input angle $\beta$ being not greater than 34°.

4. The disc chipper of claim 3, wherein said angle $\omega$ is within the range of 30° and 60°.

5. The disc chipper of claim 3, wherein the projection in the direction of the disc of the input direction of the chute feeder has both horizontal and vertical components which are in the same directions as the horizontal and vertical components of the direction of movement at the input on the surface of the disc.

6. The disc chipper of claim 3, wherein the chute feeder encounters the disc at an upper half of the disc.

7. The disc chipper of claim 3, wherein the chute feeder encounters the disc at a lower half of the disc.

* * * * *